US005611314A

United States Patent [19]

Fuwa et al.

[11] Patent Number: 5,611,314

[45] Date of Patent: Mar. 18, 1997

[54] CONTROL DEVICE FOR INTERNAL COMBUSTION ENGINE

[75] Inventors: Naohide Fuwa; Hiroshi Tanaka; Shigeki Miyashita; Hiroaki Nihei, all of Susono; Tadashi Fukuyama, deceased, late of Susono, all of Japan, by Yukio Fukuyama, legal representative

[73] Assignee: Toyota Jidosha Kabushiki Kaisha, Aichi, Japan

[21] Appl. No.: 548,116

[22] Filed: Oct. 25, 1995

[30] Foreign Application Priority Data

Oct. 26, 1994 [JP] Japan ..... 6-262854
Sep. 20, 1995 [JP] Japan ..... 7-241702

[51] Int. Cl.[6] ..... F02D 41/06; F02M 65/00

[52] U.S. Cl. ..... 123/491; 73/119 A

[58] Field of Search ..... 123/362, 435, 123/436, 467, 486, 491, 179.16, 179.17

[56] References Cited

U.S. PATENT DOCUMENTS 4,469,070 9/1984 Rassey ..... 123/462
5,020,362 6/1991 Hart et al. ..... 73/119 A
5,469,827 11/1995 Tomisawa ..... 123/491

FOREIGN PATENT DOCUMENTS 2273573 6/1994 European Pat. Off. .
61-1841 1/1986 Japan .
63-195356 8/1988 Japan .
3-19445 2/1991 Japan .
3-271538 12/1991 Japan .
3-119551 12/1991 Japan .
7-34928 2/1995 Japan .

OTHER PUBLICATIONS

Patent Abstracts of Japan, vol. 12, No. 475 (M-774), & JP-A-63 19536 (Mazda Motor Corp), Aug. 12, 1988.
Patent Abstracts of Japan, vol. 18, No. 444 (M-1658), & JP-A-06 137197 (Nippondenso Co., Ltd.), May 17, 1994.

*Primary Examiner*—Willis R. Wolfe
*Attorney, Agent, or Firm*—Kenyon & Kenyon

[57] ABSTRACT

A control device for an internal combustion engine comprises a fuel injector provided for each cylinder, an ignition plug starting ignition in each cylinder simultaneously with a start of the engine cranking, and a detection unit for detecting combustion in each cylinder when the engine is started which determines that the fuel injector of a cylinder in which ignition is carried out before fuel injection has a fuel leak when combustion is detected in the cylinder.

12 Claims, 14 Drawing Sheets

Fig.11

| | MANIFOLD-INJECTION-TYPE | | | | CYLINDER-INJECTION-TYPE | | | |
|---|---|---|---|---|---|---|---|---|
| | CYLINDER TO BE STOPPED IN INTAKE STROKE | | | | CYLINDER TO BE STOPPED IN INTAKE STROKE | | | |
| CYLINDER WITH INJECTOR WHICH HAS FUEL LEAK | #1 | #2 | #3 | #4 | #1 | #2 | #3 | #4 |
| #1 | × | ○ | ○ | ○ | ○ | × | ○ | × |
| #2 | ○ | × | ○ | ○ | ○ | ○ | × | × |
| #3 | ○ | ○ | × | ○ | × | × | ○ | ○ |
| #4 | ○ | ○ | ○ | × | × | ○ | × | ○ |

CONTROL DEVICE FOR INTERNAL COMBUSTION ENGINE

BACKGROUND OF THE INVENTION

1. Field of the Invention

The present invention relates to a control device for an internal combustion engine.

2. Description of the Related Art

Japanese Unexamined Utility Model Publication No. 3-119551 discloses a control device for a fuel injection system with an injector for injecting fuel directly into the cylinder of an internal combustion engine. This disclosure explains that the fuel injector easily leaks fuel into a cylinder when fuel is not to be injected, i.e., when fuel cut is carried out, because the pressure of fuel in a pressure chamber of the fuel injection system is kept high. To prevent the fuel leak, the control device lowers the fuel pressure in the pressure chamber during a fuel cut. The control device then corrects a fuel injection period directly after the fuel injection is restarted because a fuel pump in the fuel injection system can not quickly increase the lowered fuel pressure to a required level.

A fuel leak from a fuel injector is caused due to the inaccurate processing of the seat part of the fuel injector, the wear thereof for a long time of use, or the inclusion of a foreign object therein. In all cases, if the fuel leak per unit time is large enough to hinder the operation of the engine, the fuel injector must be replaced. On the other hand, when the fuel leak does not require replacement of the fuel injector, the above-mentioned control device tends to prevent a fuel leak during a fuel cut by lowering the pressure of fuel in the pressure chamber. However, if the fuel injector is designed to improve the sealing of the fuel injection hole by the use of the high fuel pressure in the pressure chamber, the leak will be worsened due to a decrease in the fuel pressure. In such fuel injector, even if the engine is stopped and the fuel pump is stopped and thus the fuel pressure in the pressure chamber becomes equal to an atmospheric pressure, a fuel leak occurs. Accordingly, the above-mentioned control device is incapable of preventing this kind of a fuel leak.

If the fuel leakage per unit time is small, it will not hinder the operation of the engine. However, once the fuel leakage rises to a certain level during stoppage of the engine, a large part thereof will be unburned and emitted outside when the engine is restarted, to provide a poor-quality emission.

SUMMARY OF THE INVENTION

Therefore, a object of the present invention is to provide a control device, for an internal combustion engine, capable of detecting a fuel leak in a fuel injector during a stoppage of the engine and identifying the leaking fuel injector.

According to the present invention there is provided a first control device for an internal combustion engine comprising: a fuel injector provided for each cylinder; ignition means for starting ignition in each cylinder simultaneously with a start of the engine cranking; detection means for detecting combustion in each cylinder when the engine is started; and determination means for determining that the fuel injector of a cylinder in which ignition is carried out before fuel injection by the ignition means has a fuel leak when the detection means detects combustion in the cylinder.

According to the present invention there is provided a second control device for an internal combustion engine comprising: a fuel injector provided for each cylinder; detection means for detecting combustion in each cylinder when the engine is started; and determination means for determining that the fuel injector of a cylinder in which ignition is carried out after fuel injection has a fuel leak when the detection means does not detect combustion in the cylinder.

The present invention will be more fully understood from the description of preferred embodiments of the invention set forth below, together with the accompanying drawings.

BRIEF DESCRIPTION OF THE DRAWINGS

In the drawings:

FIG. 11 is a table showing a relationship between a cylinder that has a fuel leak and target stop position of each cylinder.

DESCRIPTION OF THE PREFERRED EMBODIMENTS

Figure 1:
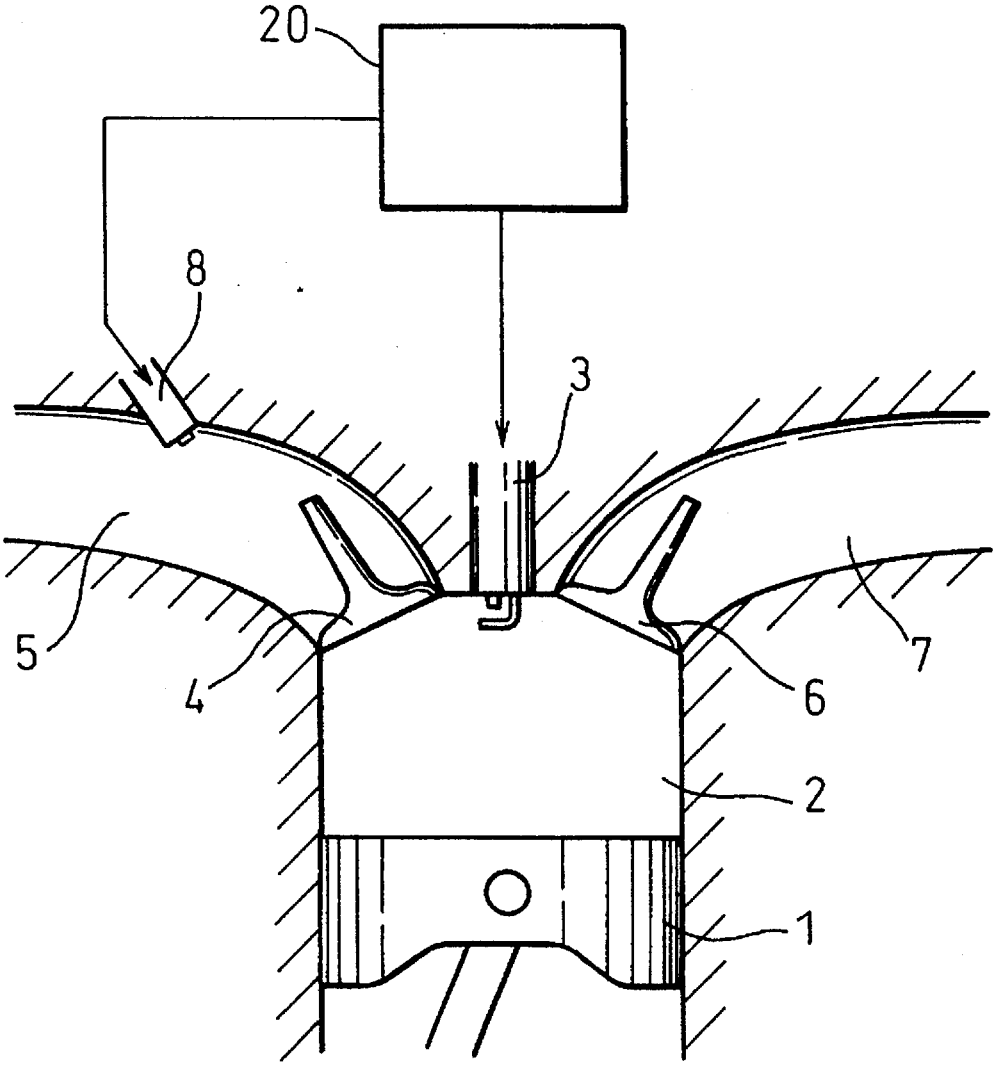
FIG. 1 is a sectional view showing a manifold-injection-type internal combustion engine with a control device of the present invention.

FIG. 1 is a sectional view showing a manifold-injection-type internal combustion engine having a control device according to the present invention. The engine has a piston 1, a combustion chamber 2, and an ignition plug 3 facing the combustion chamber 2. An intake passage 5 is connected to the combustion chamber 2 via an intake valve 4. An exhaust passage 7 is connected to the combustion chamber 2 via an exhaust valve 6. A fuel injector 8 is arranged in the intake passage 5 for each cylinder. As is well known, the fuel injector 8 is connected to a pressure chamber of a fuel injection system.

Figure 2:
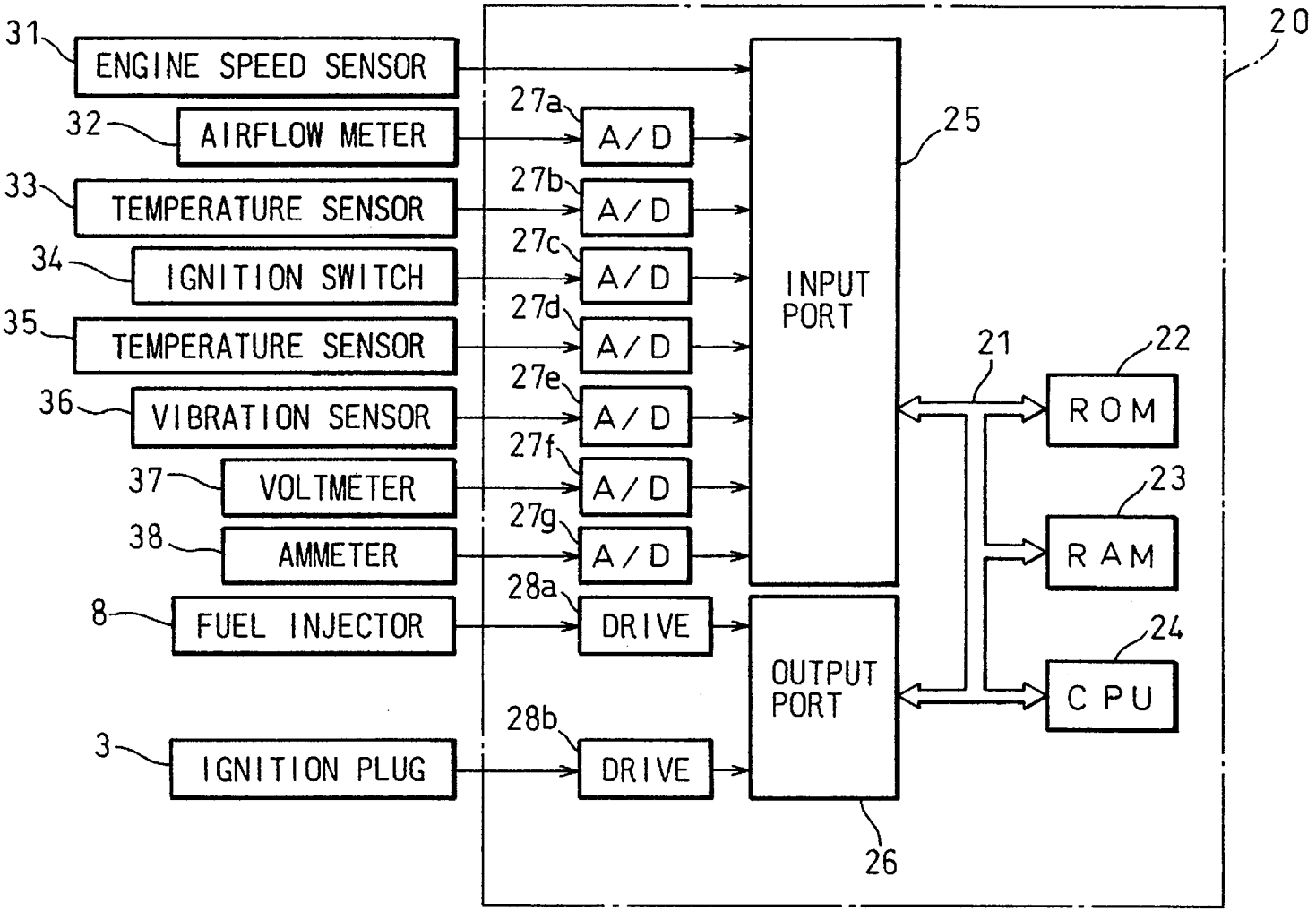
FIG. 2 is a schematic view of the ECU in FIG. 1.

Reference numeral 20 is an electronic control unit which carries out a fuel injection control via the fuel injector 8, and an ignition time control via the ignition plug 3. As shown in FIG. 2, the ECU 20 is constructed as a digital computer and includes a ROM (read only memory) 22, a RAM (random access memory) 23, a CPU (microprocessor, etc.) 24, an input port 25, and an output port 26. The ROM 22, the RAM 23, the CPU 24, the input port 25, and the output port 26 are interconnected by a bidirectional bus 21.

An engine speed sensor 31 for detecting the engine speed is connected to the input port 25. An airflow meter 32 for detecting the amount of intake air is connected to the input port 25, via an AD converter 27*a*. A temperature sensor 33 for detecting the temperature of the cooling water is connected to the input port 25, via an AD converter 27*b*. An ignition switch 34 which makes the engine start or stop is connected to the input port 25, via an AD converter 27*c*. The fuel injector 8 is connected to the output port 26, via a drive circuit 28*a*. The ignition plug 3 is connected to the output port, via a drive circuit 28*b*.

Figure 3:
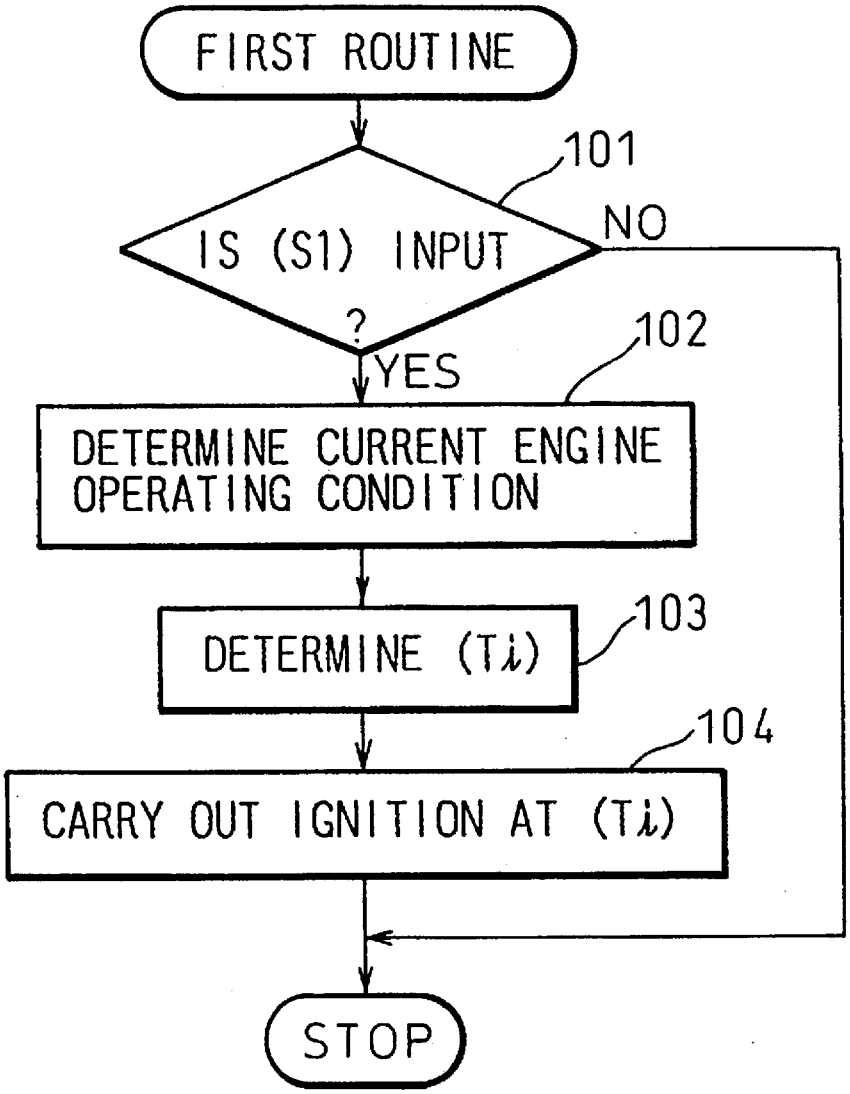
FIG. 3 is a first routine for controlling ignition time.

The ECU 20 controls the ignition time, according to a first routine shown in FIG. 3. The first routine is carried out every predetermined period, and is explained as follows. First, at step 101, it is determined whether or not a signal (S1) for starting the engine cranking is input from the ignition switch 34. When the determination is negative, the routine is stopped. On the other hand, when the determination is affirmative, the routine goes to step 102 and a current engine operating condition is determined on the basis of a current engine speed (N), a current amount of intake air (Q), and a temperature (THW) of the cooling water provided by the sensors 31, 32, 33. Next, at step 103, an optimum ignition time (Ti) for the current engine operating condition is determined from a map (not shown). At step 104, ignition is carried out at the optimum ignition time (Ti). Thus, ignition is started from a cylinder that carries out an initial compression stroke during the engine cranking.

Figure 4:
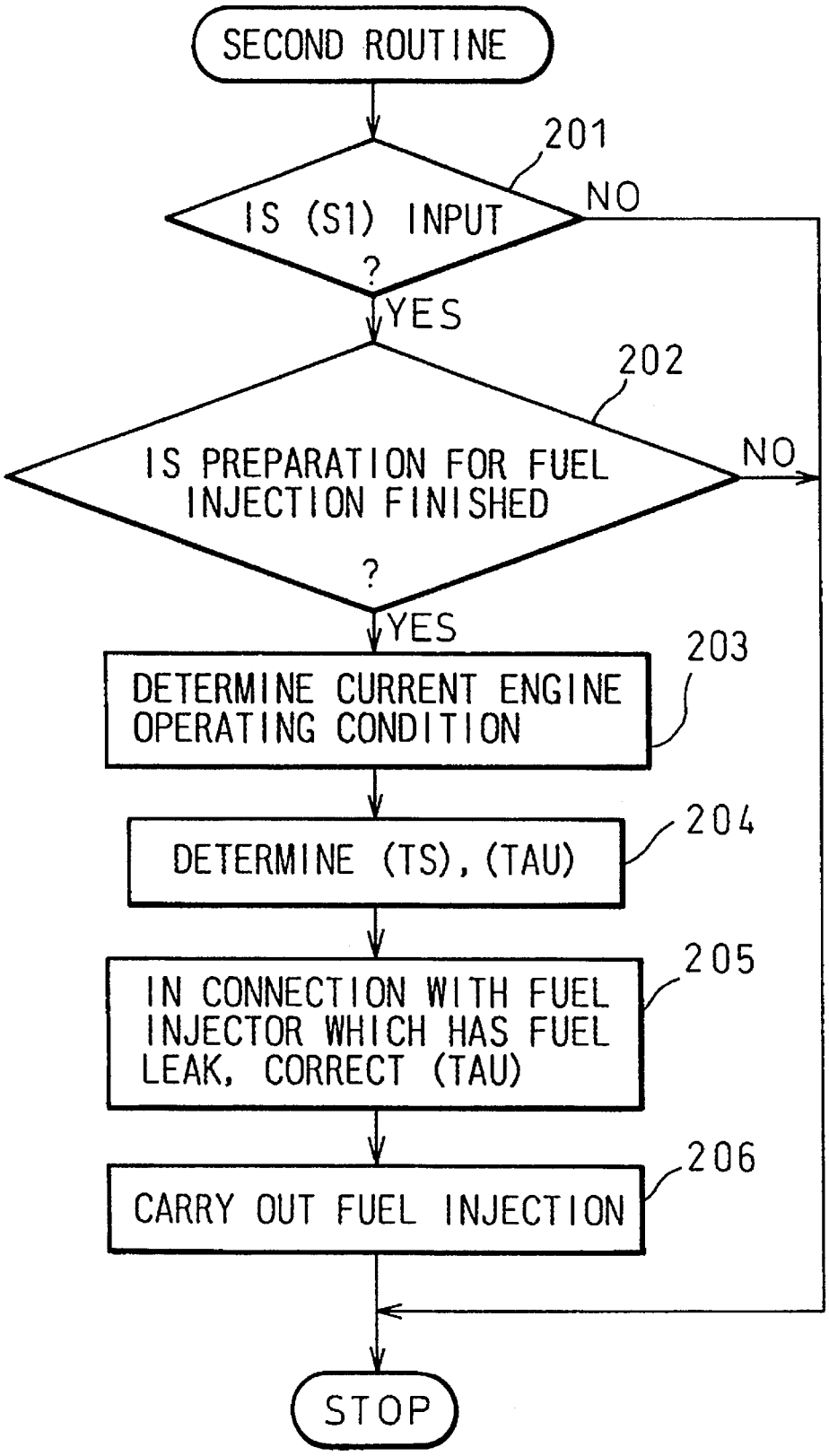
FIG. 4 is a second routine for controlling fuel injection.

The ECU 20 controls the fuel injection according to a second routine shown in FIG. 4. The second routine is carried out every predetermined period, and is explained as follows. First, at step 201, it is determined whether or not a signal (S1) for starting the engine cranking is input from the ignition switch 34. When the determination is negative, the routine is stopped. On the other hand, when the determination is affirmative, the routine goes to step 202 and it is determined whether or not the preparation for injecting fuel from the fuel injector 8 is finished. The preparation include, for example, determining that pressure in the pressure chamber of the fuel injection system has reached a predetermined value which makes the fuel injection possible. When the determination is negative, the routine is stopped. On the other hand, when the determination is affirmative, the routine goes to step 203 and a current engine operating condition is determined on the basis of a current engine speed (N), a current amount of intake air (Q), and a temperature (THW) of cooling water provided by the sensors 31, 32, 33. Next, at step 204, an optimum fuel injection start time (Ts) during an intake stroke and an optimum amount of fuel injected (THU) for the current engine operating condition are determined from maps (not shown), respectively. At step 205, in connection with the fuel injector which has a fuel leak, the optimum amount of fuel injected (THU) is corrected (TAU'=TAU–TAUK) in at least an initial fuel injection. This is explained in detail later. Next, step 206, fuel injection is carried out on the basis of the optimum fuel injection start time (Ts) and the optimum amount of fuel (THU) or the corrected amount thereof (TAU–TAUK). Thus, fuel injection is started from a cylinder that reaches an initial intake stroke after the preparation for fuel injection is finished.

Figure 5:
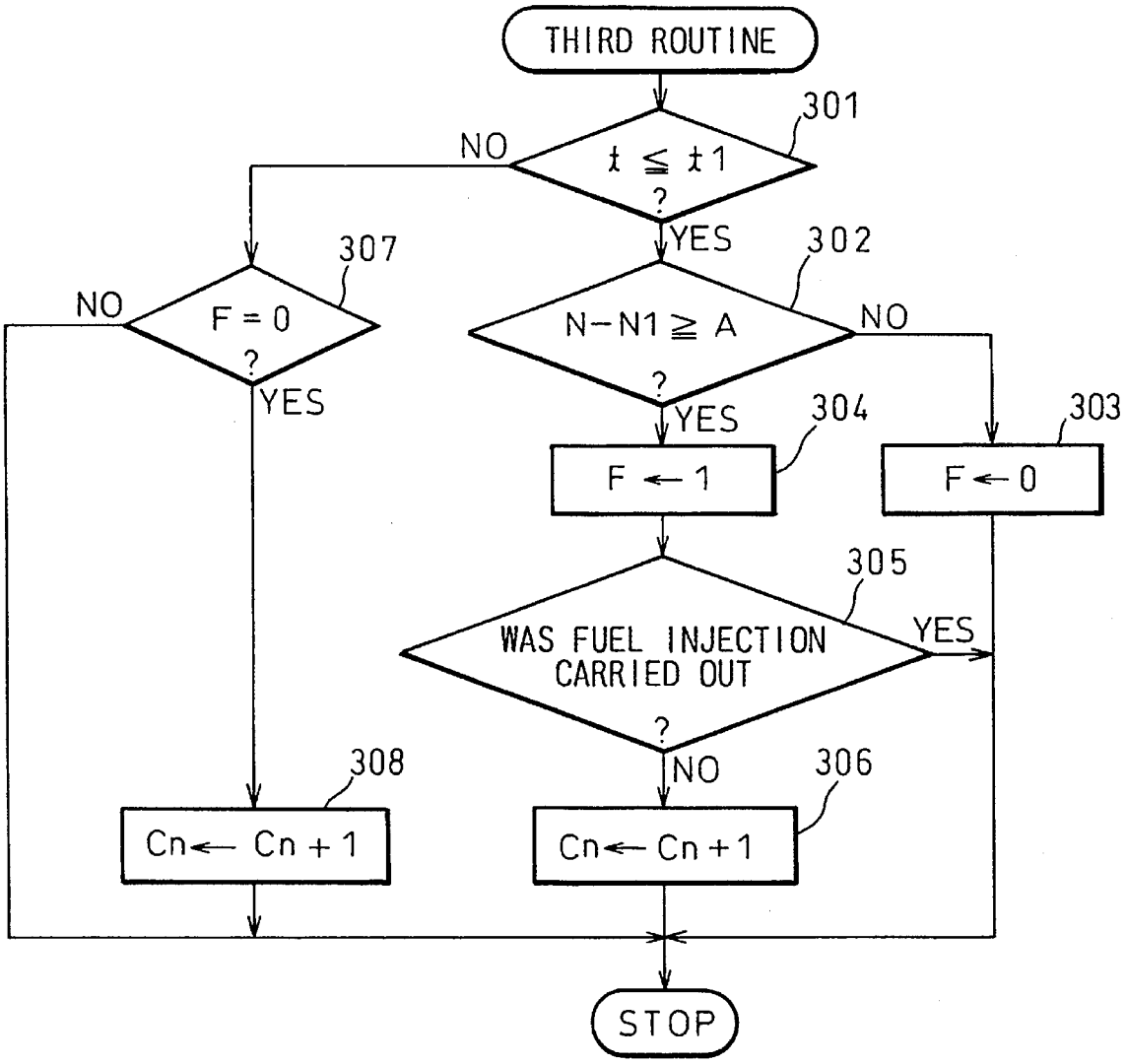
FIG. 5 is a third routine for detecting a fuel leak of a fuel injector and identifying the leaking fuel injector.

FIG. 5 is a third routine for detecting a fuel leak of a fuel injector and identifying the leaking fuel injector through the above-mentioned ignition time control and fuel injection control. The routine is carried out at every explosion stroke of each cylinder. First, at step 301, it is determined whether or not time (t) which elapses after a signal (S1) for starting the engine cranking is input from the ignition switch 34 is shorter than or equal to a predetermined time (t1). When the determination is affirmative, a cylinder in which an initial fuel injection is carried out has not yet completed an explosion stroke after the initial fuel injection was finished, and the routine goes to step 302.

At step 302, it is determined whether or not a difference between a current engine speed (N) and the cranking engine speed (N1) is above a predetermined value (A). When the determination is negative, the routine goes to step 303 and thus a flap (F) is reset (0). Next, the routine is stopped. On the other hand, when the determination at step 302 is affirmative, the routine goes to step 304 and thus the flag (F) is set (1). Next, at step 305, it is determined whether or not a fuel injection was already carried out in a cylinder that is presently in an explosion stroke. When the determination is affirmative, the routine is stopped. On the other hand, when the determination is negative, the routine goes to step 306 and thus it is determined that the fuel injector of this cylinder has a fuel leak so that a fuel leak count value (Cn) (for example, in the case that the engine has four cylinders, n=1 to 4) of this cylinder is increased by one. Each of the count values (C1), (C2), (C3), and (C4) of the respective cylinders is set to (0) when the engine is started for the first time. These count values are not reset even if the engine is stopped.

Once such flow is repeated and the determination at step 301 is negative, the routine goes to step 307 and thus it is determined whether or not the flag (F) is (0). When the determination at step 307 is negative, the routine is stopped. On the other hand, when the determination at step 307 is affirmative, the routine goes to step 308 and thus it is determined that the fuel injector of the cylinder that the first fuel injection is carried out has a fuel leak so that the fuel leak count value (Cn) of this cylinder is increased by one.

Figure 6:
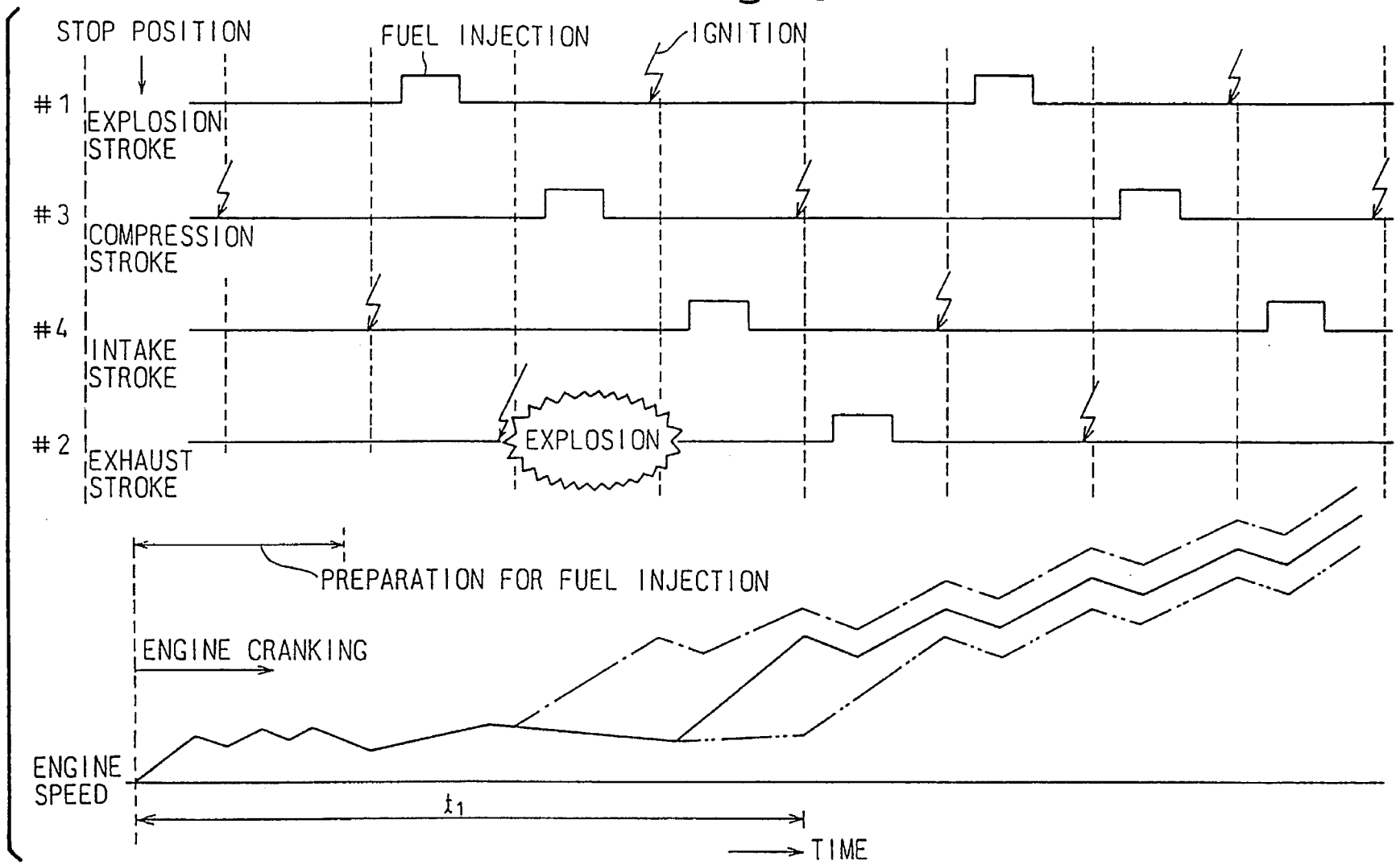
FIG. 6 is a time chart showing ignition time, fuel injection time, and an engine speed from the engine cranking start.

FIG. 6 is a time chart from showing the ignition time, fuel injection time, and engine speed, in a start of a manifold-injection-type four-cylinder internal combustion engine. This engine injects fuel during an intake stroke. The first to fourth cylinders are ignited in order of #1, #3, #4, and #2. The figure shows that the engine is stopped with the first cylinder #1 being in an explosion stroke, the third cylinder #3 in a compression stroke, the fourth cylinder #4 in an intake stroke, and the second cylinder #2 in an exhaust stroke.

A continuous line in the time chart represents changes in the engine speed in the case that every fuel injector has no fuel leak. In this case, the engine is cranked with the cylinders being in the stopped strokes, and in the first cylinder that reaches an intake stroke after the preparedness for fuel injection (after about one turn of the engine cranking) is finished, an initial fuel injection is carried out. Accordingly, an initial explosion occurs in the initial explosion stroke of the first cylinder, and at the same time, the engine speed exceeds the cranking speed. Thereafter, the third, fourth, and second cylinders successively cause an explosion, to gradually increase the engine speed.

On the other hand, a dot-and-dash line of the time chart represents changes in the engine speed when the second cylinder has a fuel leak. In an intake stroke of the second cylinder just after the start of cranking, no fuel injection is carried out. In spite of no fuel injection, fuel leaked into the intake passage of the second cylinder is drawn into the cylinder with intake air. Since ignition is started simultaneously with the start of cranking, the second cylinder causes an explosion when it is ignited in a compression stroke. As a result, the engine speed exceeds the cranking speed before the explosion stroke of the first cylinder that the first fuel injection is carried out. Accordingly, the determination at step 305 of the third routine is negative, and at step 306, the fuel leak count value (C2) of the second cylinder is increased by one. Namely, it is determined that the fuel injector of the second cylinder has a fuel leak.

A two-dot chain line of the time chart represents changes in the engine speed when the first cylinder has a fuel leak. In this case, fuel leaked into the intake passage as well as injected fuel are drawn into the first cylinder with intake air in an intake stroke just after the start of cranking. Due to this excessive fuel, no explosion occurs even if the cylinder is ignited in the following compression stroke. Accordingly, the flag (F) is remains at (0) without passing the step 304, and therefore, the determination at step 307 is affirmative, and at step 308 the fuel leak count value (C1) of the first cylinder is increased by one. Namely, it is determined that the fuel injector of the first cylinder has a fuel leak.

When the cylinders are stopped in the strokes shown in FIG. 6, it is possible to surely detect a fuel leak of the fuel injector of any one of the first and second cylinders. For the other cylinders, they will be stopped in strokes that let a fuel leak be surely detected after the engine is repeatedly stopped and started. Accordingly, a fuel leak in any one of the cylinders will be detected.

If a cylinder having a leaking fuel injector in the manifold-injection-type internal combustion engine is stopped in an intake stroke, only a part of the leaked fuel is supplied into the cylinder during the latter half of the intake stroke as soon as the engine is cranked and the amount of fuel supplied is not enough to burn in the cylinder. Accordingly, the unburned fuel can be discharged in an exhaust stroke, to deteriorate the quality of emission. To avoid this problem, if the third routine of FIG. 5 detects the fuel leak and the fuel injector having the leaking fuel injector is identified, a fourth routine of FIG. 7 can control a fuel cut time when the engine is stopped so that the cylinder in question is not stopped in an intake stroke.

Figure 7:
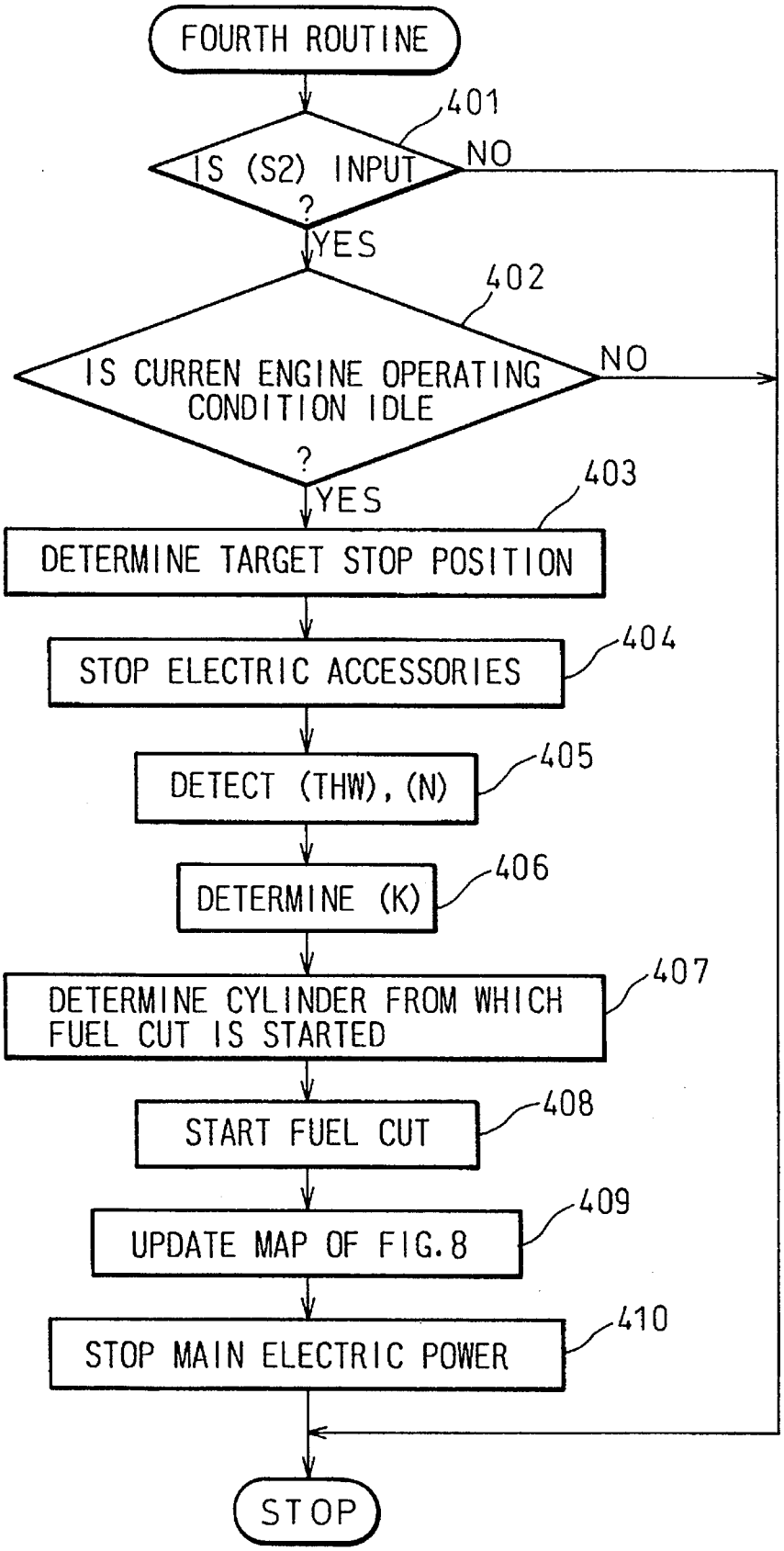
FIG. 7 is a fourth routine for controlling fuel cut time when the engine is stopped.

The fourth routine of FIG. 7 is carried out at intervals of predetermined crank angles. At step 401, it is determined whether or not a signal (S2) for stopping the engine is input from the ignition switch 34. When the determination is negative, the routine is stopped. On the other hand, when the determination is affirmative, the routine goes to step 402, it is determined whether or not an accelerator pedal is released and a current engine operation is an idle condition. Usually, when a current engine operation is an idle condition, the signal (S2) is input, so that the determination at step 402 is usually affirmative. However, if the determination at step 402 is negative, the routine is repeated until the determination is affirmative. Thereafter, the routine goes to step 403.

At step 403, a target stop position of each cylinder is determined, according to the injector which has a fuel leak and any injector which is not yet tested for a fuel leak. Next, at step 404, electric accessories, such as an air conditioner, that put load on the engine are stopped. At step 405, a cooling water temperature (THW) is detected, as a value representing an engine friction based on the viscosity of a lubricant, and an engine speed (N) is detected, as a value representing kinetic energy. According to these values, at step 406, an engine revolution angle (K) by the engine stopping after fuel cut is carried out from a given cylinder in the idle engine speed, is determined from a map FIG. 8. Next, the routine goes to step 407.

Figure 8:
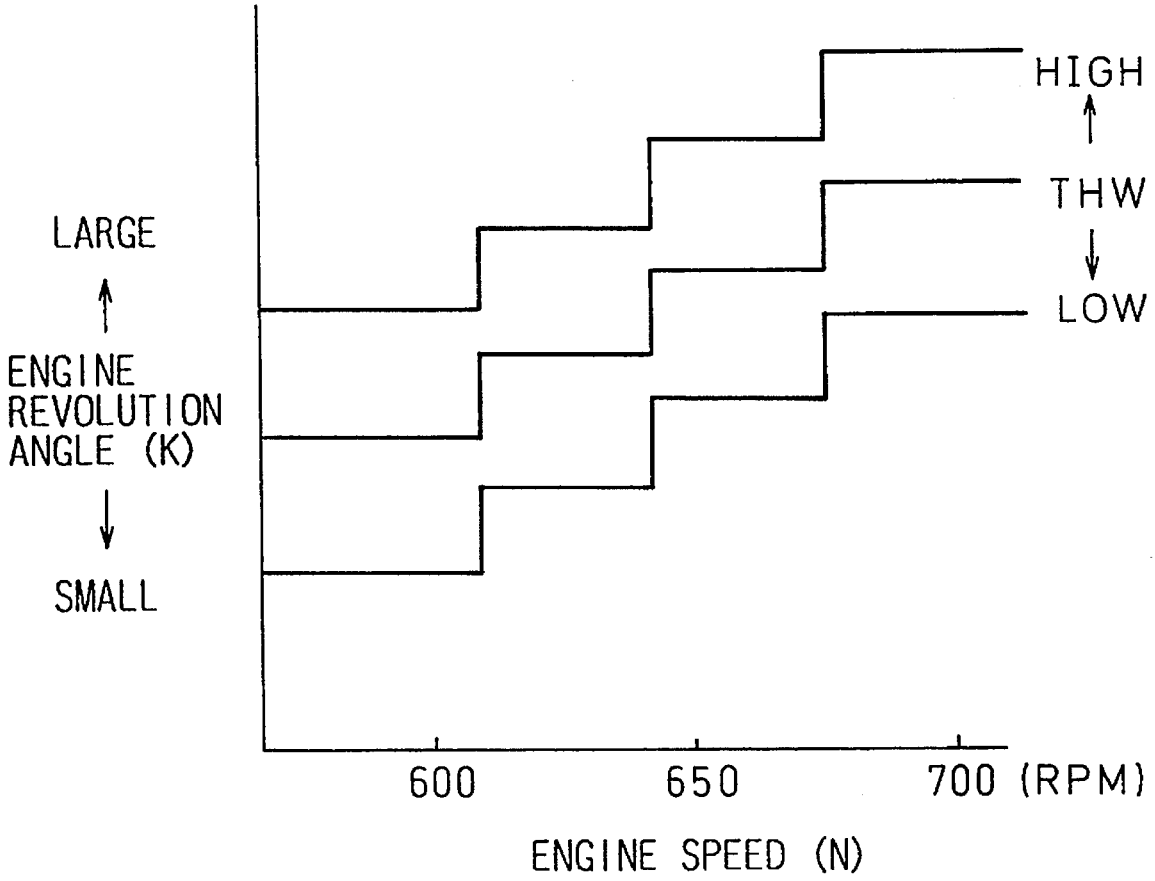
FIG. 8 is a map used to determine the engine revolution angle.

At step 407, according to the engine revolution angle (K), a cylinder from which the fuel cut is started to realize the target stop position of each cylinder is determined. At step 408, fuel cut is started from the determined cylinder. Next, at step 409, the actual engine revolution angle by the engine stopping after fuel cut is carried out from the determined cylinder is detected, and thus according to the actual angle, the map of FIG. 8 is updated. At step 410, a main electric power is stopped, and the routine is stopped.

Figure 9:
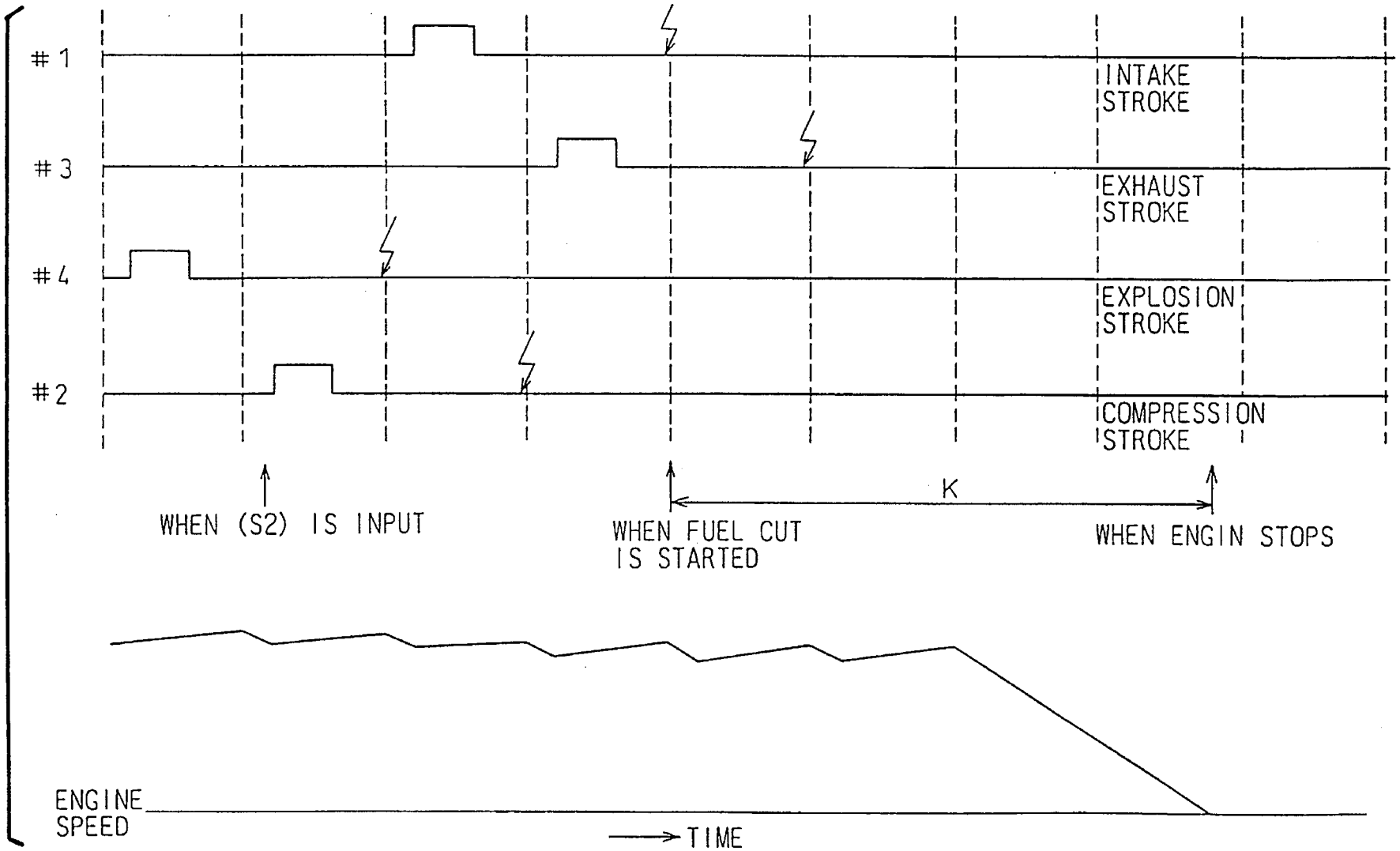
FIG. 9 is a time chart showing ignition time, fuel injection time, and an engine speed when the engine is stopped.

For example, if it is determined that the fuel injector of the second cylinder has a fuel leak and that the fuel injector of the third cylinder is not yet tested for a fuel leak, it is preferable to stop the third cylinder in an exhaust stroke and the second cylinder in a compression stroke because the target stop position of the second cylinder must be other than an intake stroke. In the case that the engine revolution angle (K) is about 360 degrees on the basis of the above-mentioned values, the fuel cut time is delayed after the signal (S2) for stopping the engine is input from the ignition switch, such that the fuel cut is started from the fourth cylinder as shown in a time chart of FIG. 9. In a four-cycle engine, the engine revolution angle (K) is about 720 degrees at the maximum. A required time to realize the revolution angle (K) is about 0.2 seconds under a usual idling operation, and therefore, the driver will never sense the delay in the engine stop timing.

Figure 10:
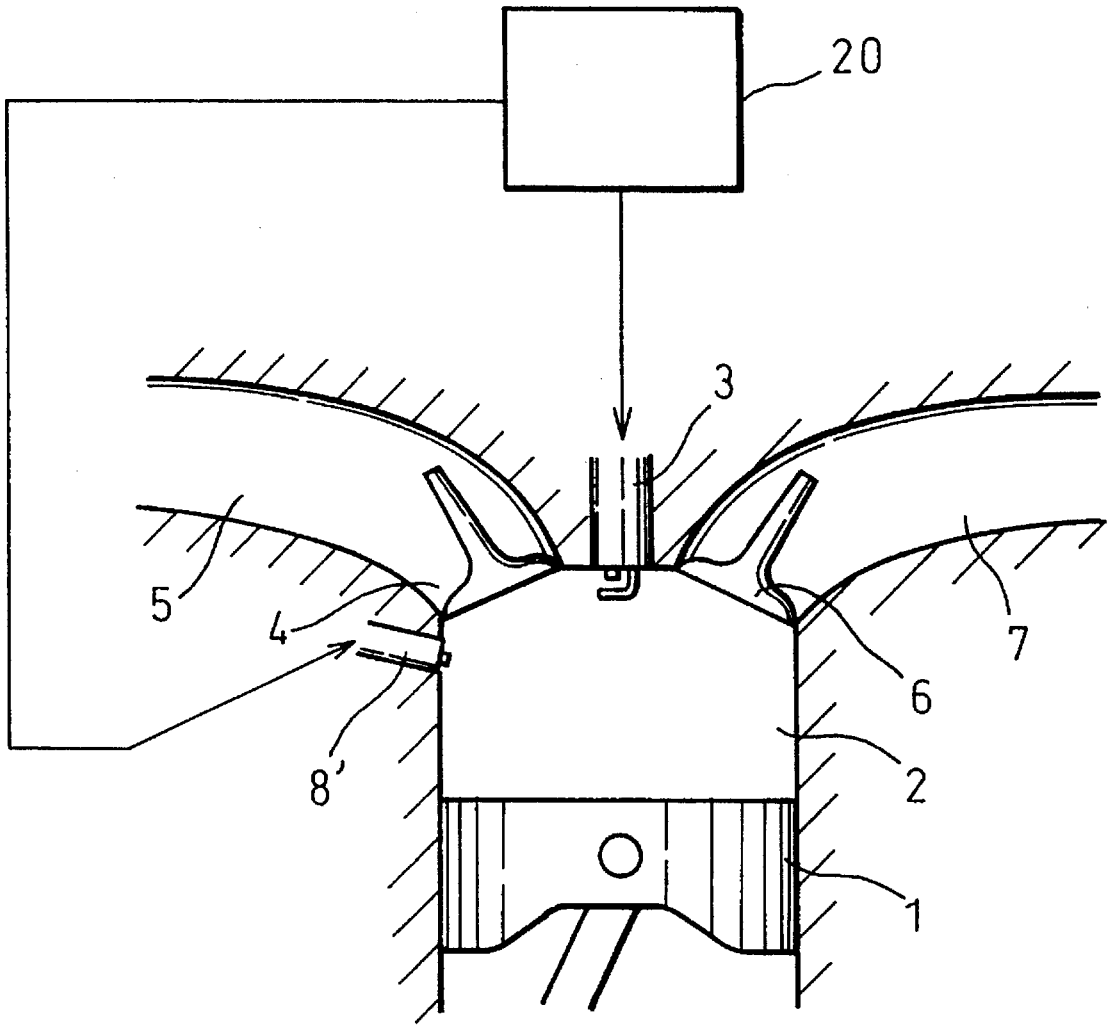
FIG. 10 is a sectional view showing a cylinder-injection-type internal combustion engine with a control device of the present invention.

Although the present invention has been explained with reference to the manifold-injection-type internal combustion engine in which a fuel injection is carried out during an intake stroke, the present invention is also applicable to manifold-injection-type internal combustion engines in which a fuel injection is carried out before an intake stroke. Moreover, the present invention is also applicable to a cylinder-injection-type internal combustion engines as shown in FIG. 10. The engine has a fuel injector 8' which is arranged in the cylinder head and injects fuel directly into the combustion chamber 2. Fuel injection of the engine is carried out during an intake stroke or during a compression stroke. FIG. 11 shows a target stop position of each cylinder to surely burn leaked fuel when any one of fuel injectors leaks fuel in the manifold-injection-type and cylinder-injection-type internal combustion engines. As shown in this figure, if the fuel injector of the second cylinder of the manifold-injection-type engine has a fuel leak, the target stop position of one of the first, third, and fourth cylinders will be in an intake stroke. If the fuel injector of the second cylinder of the cylinder-injection-type engine has a fuel leak, the target stop position of the second or first cylinder will be in an intake stroke.

In the cylinder-injection-type engine, fuel leaks directly into a cylinder. Accordingly, if the second cylinder is in an explosion or exhaust stroke when the engine cranking is started, the leaked fuel will be unburned and discharged from the cylinder. It is preferable to set the target stop position of the second cylinder to an intake stroke, to extend a period between the engine cranking start and an ignition time of the second cylinder. If a plurality of the fuel injectors have fuel leaks, the target stop positions of the cylinders are determined to minimize the number of cylinders that discharge unburned leaked fuel. If three of the fuel injectors have fuel leaks in the cylinder-injection-type engine, the leaked fuel of one of the cylinders will be unburned and discharged from the cylinder. It is preferable to make this cylinder the one having the smallest fuel leak count value (Cn) in the third routine.

In the case that the fuel injector of a given cylinder has a fuel leak in the manifold-injection-type internal combustion engine in which a fuel injection is carried out during an intake stroke, if a period between the stoppage and restart of the engine is short, the leak will be small so that the leaked fuel will not burn. To prevent this, the stop position of the cylinder in question is set to an explosion or compression stroke, so that fuel injection is carried out as soon as the leaked fuel is supplied into the cylinder in the first intake stroke during the engine cranking.

Figure 12:
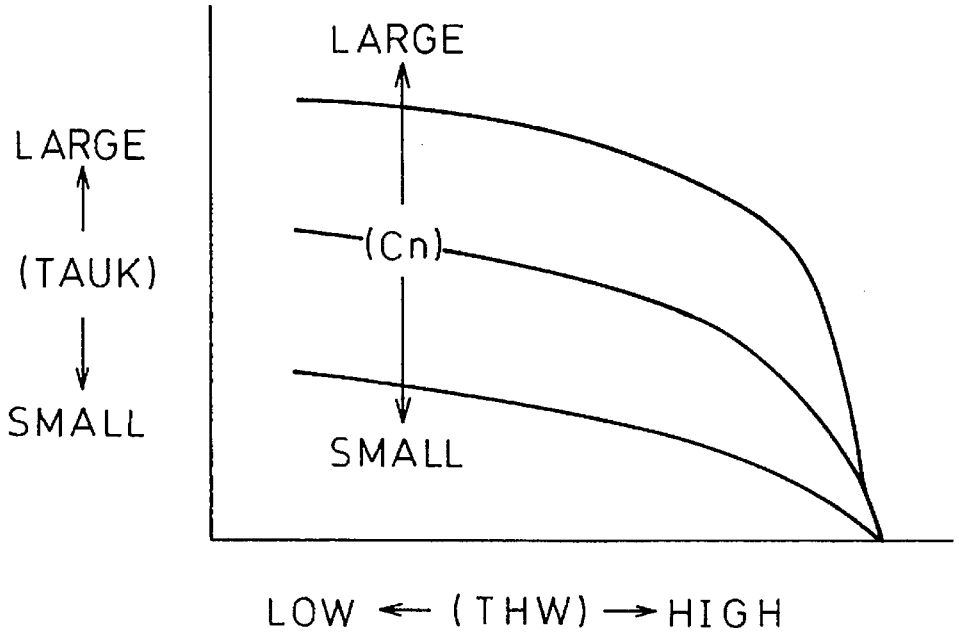
FIG. 12 is a map used to determine an amount of fuel leaked during a stoppage of the engine.
Figure 13:
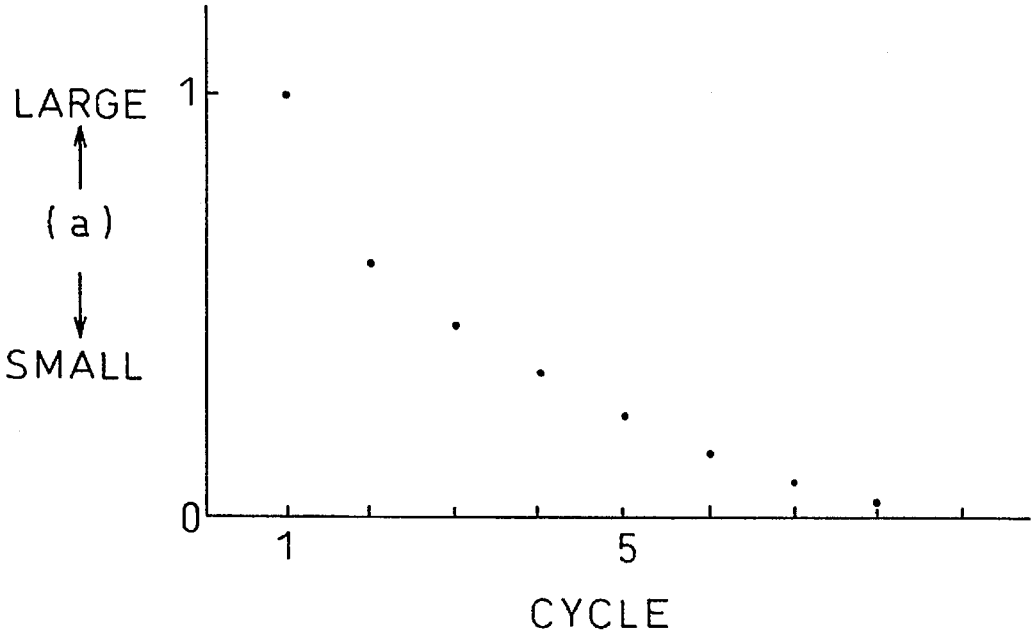
FIG. 13 is a map used to determine a coefficient for correcting the amount of fuel reduced.

In this case, an air-fuel ratio will be too rich if the amount of injected fuel is a usual optimum one determined according to the operating conditions of the engine because the leaked fuel is added to the injected fuel. Therefore, the fuel will not burn, and a large amount of unburned fuel will be discharged. To solve this problem, the optimum amount of fuel injected (TAU) is corrected at step 205 of the second routine for controlling fuel injection. In this correction, a map of FIG. 12 is used to estimate an amount of fuel leaked (TAUK) during the engine stoppage and the amount of fuel leaked (TAUK) is subtracted from the optimum amount of fuel injected (TAU) in an initial fuel injection of the fuel injector which has a fuel leak. The map of FIG. 12 is set such that the higher the temperature of cooling water (THW) at the start of the engine and the larger the fuel leak count value (Cn) is, the larger the amount of fuel leaked (TAUK) become. Because, the higher the temperature (THW) is, the shorter the time during the engine stoppage is. In connection with the fuel leak count value (Cn), the larger the fuel leak count value (Cn) is, the larger a degree of fuel leak in the fuel injector is. Because, when the fuel leak count value (Cn) is large, a fuel leak of the fuel injector is detected even if the engine stopped period is short. In any one of the manifold-injection-type and cylinder-injection-type internal combustion engines, leaked fuel adheres to the intake passage or the cylinder, and the adhered fuel will not burn all at once. The remaining fuel is used for the next combustion. Considering this phenomenon, the amount of injected fuel may be gradually brought to an optimum value without suddenly achieving the optimum value in the next combustion. The map of FIG. 13 shows a coefficient (a) for correcting the amount of fuel reduced (TAUK) with respect to the number of cycles, i.e., the number of fuel injection operations carried out in a given one of the cylinders. According to this correction, an amount of fuel injected is made (TAU–TAUK*a) in the fuel injector which has a fuel leak. This technique is also applicable to the cylinder-injection-type internal combustion engine. To surely burn leaked fuel when fuel injection is carried out in an intake stroke, only the first fuel injection operation is delayed up to a compression stroke.

At step 302 of the third routine, it is determined whether or not a given cylinder has caused combustion according to an increase in an engine speed. This does not limit the present invention. For example, the amount of intake air suddenly increases when the combustion causes an increase in the engine speed. Accordingly, determining whether or not a cylinder has caused combustion may be made by monitoring the amount of intake air with use of the airflow meter 32 disposed in the intake passage. Each cylinder may be provided with a temperature sensor 35 or a vibration sensor 36, as shown in FIG. 2, to directly detect heat or vibration caused by combustion.

Figure 14:
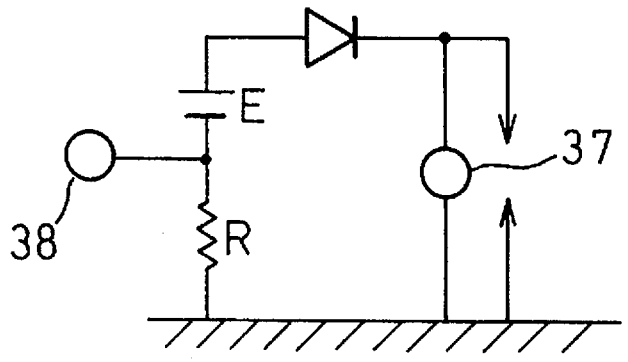
FIG. 14 shows a first circuit for detecting an ion current.
Figure 15:
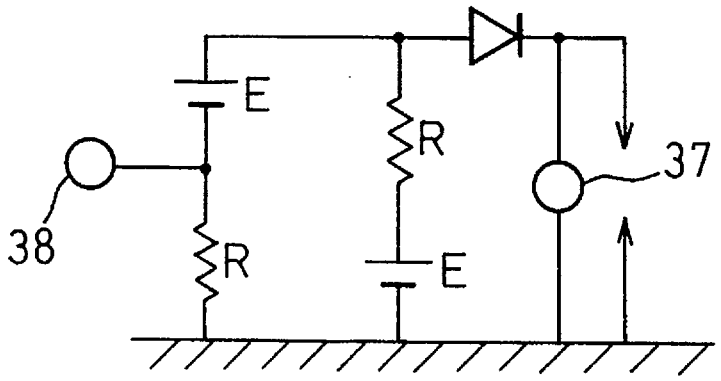
FIG. 15 shows a second circuit for detecting an ion current.
Figure 16:
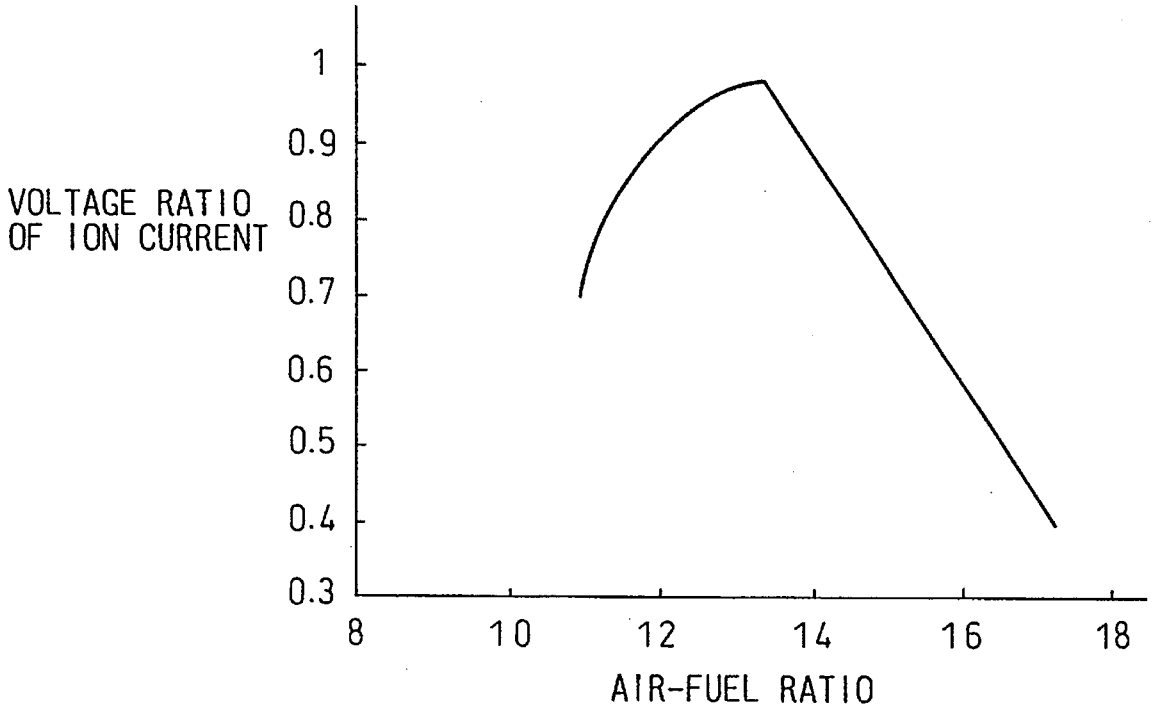
FIG. 16 is a graph showing a relationship between the voltage ratio of an ion current and an air-fuel ratio.

Alternatively, electrodes facing each other and spaced from each other may be arranged in each cylinder, to form one of circuits shown in FIGS. 14 and 15. As usually known, when combustion occurs, an ion current flows through the circuit. Monitoring the ion current by an ammeter 38 may detect the combustion. The voltage of the ion current changes in response to an air-fuel ratio as shown in FIG. 16. The voltage of the ion current is detected by a voltmeter 37 and it is possible, therefore, to estimate the amount of leaked fuel according to the air-fuel ratio, to thereby accurately correct a reduction in the amount of injected fuel at the start of the engine. The electrodes disposed in each cylinder may be the ignition plug 3.

In the third routine, a fuel leak in a cylinder is detected by determining whether or not the cylinder has caused combustion without fuel injection, or whether or not the cylinder has caused no combustion even after fuel has been injected. To make the former determination, ignition must be started from a cylinder that first reaches a compression stroke. To make the latter determination, it is not necessary to start ignition so early.

Although the invention has been described with reference to specific embodiments thereof, it should be apparent that numerous modifications can be made thereto by those skilled in the art, without departing from the basic concept and scope of the invention.

We claim:

1. A control device of an internal combustion engine comprising:

a fuel injector provided for each cylinder;

ignition means for starting ignition in each cylinder simultaneously with a start of the engine cranking;

detection means for detecting combustion in each cylinder when the engine is started; and determination means for determining that the fuel injector of a cylinder in which ignition is carried out before fuel injection by said ignition means has a fuel leak when said detection means detects combustion in said cylinder.

2. A control device according to claim 1, further comprising fuel cut delay means for delaying fuel cut time after an engine stop instruction to stop the cylinder having the leaking fuel injector determined by said determination means in a predetermined stroke so that fuel leaked during a stoppage of the engine can burn when the engine is started.

3. A control device according to claim 2, wherein said fuel cut delay means determines the fuel cut delay period from the engine stop instruction according to at least one of the temperature of cooling water and an engine speed, at the engine stop instruction.

4. A control device according to claim 1, further comprising fuel reducing means for reducing fuel to be injected from the leaking fuel injector determined by said determination means when the engine is started.

5. A control device according to claim 4, wherein said fuel reduction means estimates an amount of fuel leaked from the leaking fuel injector during a stoppage of the engine and determines an amount of a fuel reduced according to the amount of fuel leaked.

6. A control device according to claim 5, wherein said fuel reduction means estimates an amount of fuel leaked during a stoppage of the engine according to a decrease in the temperature of cooling water.

7. A control device of an internal combustion engine comprising:

a fuel injector provided for each cylinder;

detection means for detecting combustion in each cylinder when the engine is started; and determination means for determining that the fuel injector of a cylinder in which ignition is carried out after fuel injection has a fuel leak when said detection means does not detect combustion in said cylinder.

8. A control device according to claim 7, further comprising fuel cut delay means for delaying fuel cut time after an engine stop instruction to stop the cylinder having the leaking fuel injector determined by said determination means in a predetermined stroke so that fuel leaked during a stoppage of the engine can burn when the engine is started.

9. A control device according to claim 8, wherein said fuel cut delay means determines the fuel cut delay period from the engine stop instruction according to at least one of the temperature of cooling water and an engine speed, at the engine stop instruction.

10. A control device according to claim 7, further comprising fuel reduction means for reducing fuel to be injected from the leaking fuel injector determined by said determination means when the engine is started.

11. A control device according to claim 10, wherein said fuel reduction means estimates an amount of fuel leaked from the leaking fuel injector during a stoppage of the engine and determines an amount of a fuel reduced according to the amount of fuel leaked.

12. A control device according to claim 11, wherein said fuel reduction means estimates an amount of fuel leaked during a stoppage of the engine according to a decrease in the temperature of cooling water.

* * * * *